US005689150A

United States Patent [19]

Ragland, Jr.

[11] Patent Number: 5,689,150

[45] Date of Patent: Nov. 18, 1997

[54] COLOR PICTURE TUBE HAVING IMPROVED SHADOW MASK FRAME

[75] Inventor: Frank Rowland Ragland, Jr., Lancaster, Pa.

[73] Assignee: Thomson Consumer Electronics, Inc., Indianapolis, Ind.

[21] Appl. No.: 557,472

[22] Filed: Nov. 14, 1995

[51] Int. Cl.[6] ..... H01J 29/07

[52] U.S. Cl. ..... 313/402; 313/407

[58] Field of Search ..... 313/402, 403, 313/404, 405, 416, 407, 408

[56] References Cited

U.S. PATENT DOCUMENTS 3,516,147 6/1970 Seedorff et al. .

FOREIGN PATENT DOCUMENTS 988141 4/1976 Canada .

*Primary Examiner*—Sandra L. O'Shea

*Assistant Examiner*—Vip Patel

*Attorney, Agent, or Firm*—Joseph S. Tripoli; Dennis H. Irlbeck

[57] ABSTRACT

An improved color picture tube includes an evacuated envelope having a rectangular faceplate panel. The panel includes a viewing screen on an inner surface thereof and a shadow mask-frame assembly mounted therein. The shadow mask-frame assembly includes an apertured shadow mask and a peripheral frame to which the mask is attached. The improvement comprises the frame being formed by eight sections, two identical long side sections, two identical short side sections and four corner sections, that are attached together edge-to-edge. The two long side sections and the two short side sections are thinner than the four corner sections.

2 Claims, 2 Drawing Sheets

COLOR PICTURE TUBE HAVING IMPROVED SHADOW MASK FRAME

This invention relates to a color picture tube of the type having a shadow mask attached to a peripheral flame which is suspended in relation to a viewing screen of the tube, and particularly to such a tube having an improved shadow mask flame with reduced weight.

BACKGROUND OF THE INVENTION

As the sizes of color picture tubes have increased, there has been a corresponding increase in the sizes and weights of tube components. One of these components is the shadow mask frame. Present color picture tubes use steel flames to support the shadow masks within the faceplate panels of the tubes. One type of flame is made from a continuous piece of L-shaped steel that is bent and welded to itself at its ends. Another type of frame is formed by pressing a flat steel sheet into the shape of the frame. A third type of frame is disclosed in Canadian Patent 988,141, issued to RCA Corporation (T. M. Shrader and K. A. Long) on Apr. 27, 1976. That patent shows a rectangular frame that is formed from four pieces that are welded together at the four corners of the flame. The cited purpose of using the four pieces is to provide an adjustable frame to precisely fit within a particular mask. Each of the four pieces has two flanges configured in an L-shaped cross-section. A first of the flanges extends toward a screen of the tube, and a second flange extends from the first flange toward a central longitudinal axis of the tube. For each piece, the first flange extends beyond the second flange at both ends of the piece. These extensions of the first flange overlap each other in the corners of the flame, where the pieces are welded together.

The three flame types discussed above are usually supported within a faceplate panel by either three or four springs that are attached to the sides of the flame. Recently, large tubes have been suggested that are supported within faceplates by four springs located at the corners of the mask flame. A lightweight flame favorably affects mechanical shock performance, cost and the time it takes to reach a stable operating temperature in a color picture tube. If the frame is too light at the points of attachment for the spring supports utilized, it may deform and cause poor performance. Frames made with lightweight sides and thick corners, that are first formed and then joined together, have been found to suffer because of mechanical dimensional inconsistency. The present invention provides a frame that has a high degree of mechanical dimensional consistency, as well as reduced weight.

SUMMARY OF THE INVENTION

An improved color picture tube includes an evacuated envelope having a rectangular faceplate panel. The panel includes a viewing screen on an inner surface thereof and a shadow mask-frame assembly mounted therein. The shadow mask-frame assembly includes an apertured shadow mask and a peripheral frame to which the mask is attached. The improvement comprises the frame being formed by eight sections, two identical long side sections, two identical short side sections and four corner sections, that are attached together edge-to-edge. The two long side sections and the two short side sections are thinner than the four corner sections.

DETAILED DESCRIPTION OF THE PREFERRED EMBODIMENTS

Figure 1:
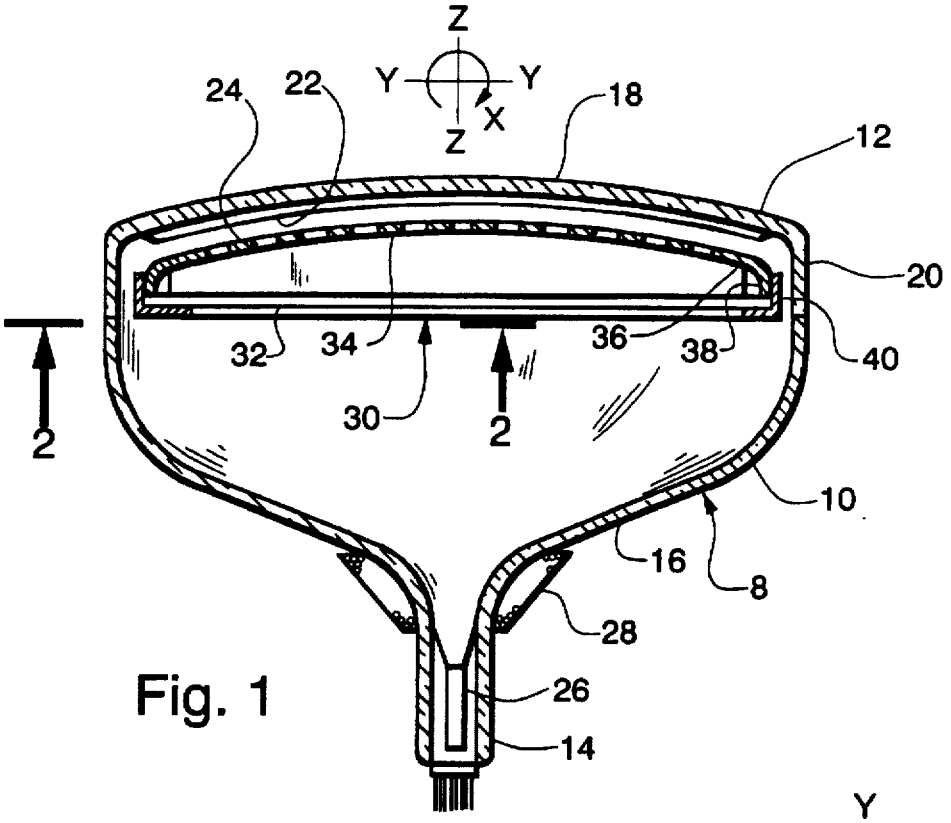
FIG. 1 is an axially sectioned side view of a color picture tube embodying the present invention.

FIG. 1 shows a rectangular color picture tube 8 having a glass envelope 10, comprising a rectangular faceplate panel 12 and a tubular neck 14 connected by a rectangular funnel 16. The panel 12 comprises a viewing faceplate 18 and a peripheral flange or sidewall 20 which is sealed to the funnel 16. The faceplate panel 12 includes two orthogonal axes: a major axis X, parallel to its wider dimension (usually horizontal), and a minor axis Y, parallel to its narrower dimension (usually vertical). The major and minor axes are perpendicular to a central longitudinal axis Z of the tube, which passes through both the center of the neck 14 and the center of the panel 12. A mosaic three-color phosphor screen 22 is located on the inner surface of the faceplate 18. The screen preferably is a line screen, with the phosphor lines extending substantially parallel to the minor axis Y. Alternatively, the screen may be a dot screen. A multiapertured color selection electrode or shadow mask 24 is removably mounted in predetermined spaced relation to the screen 22. An electron gun 26 is centrally mounted within the neck 14, to generate and direct three electron beams along convergent paths through the mask 24 to the screen 22.

The tube of FIG. 1 is designed to be used with an external magnetic deflection yoke 28 located in the vicinity of the funnel-to-neck junction. When activated, the yoke 28 subjects the three electron beams to magnetic fields which cause the beams to scan horizontally and vertically in a rectangular raster over the screen 22.

Figure 2:
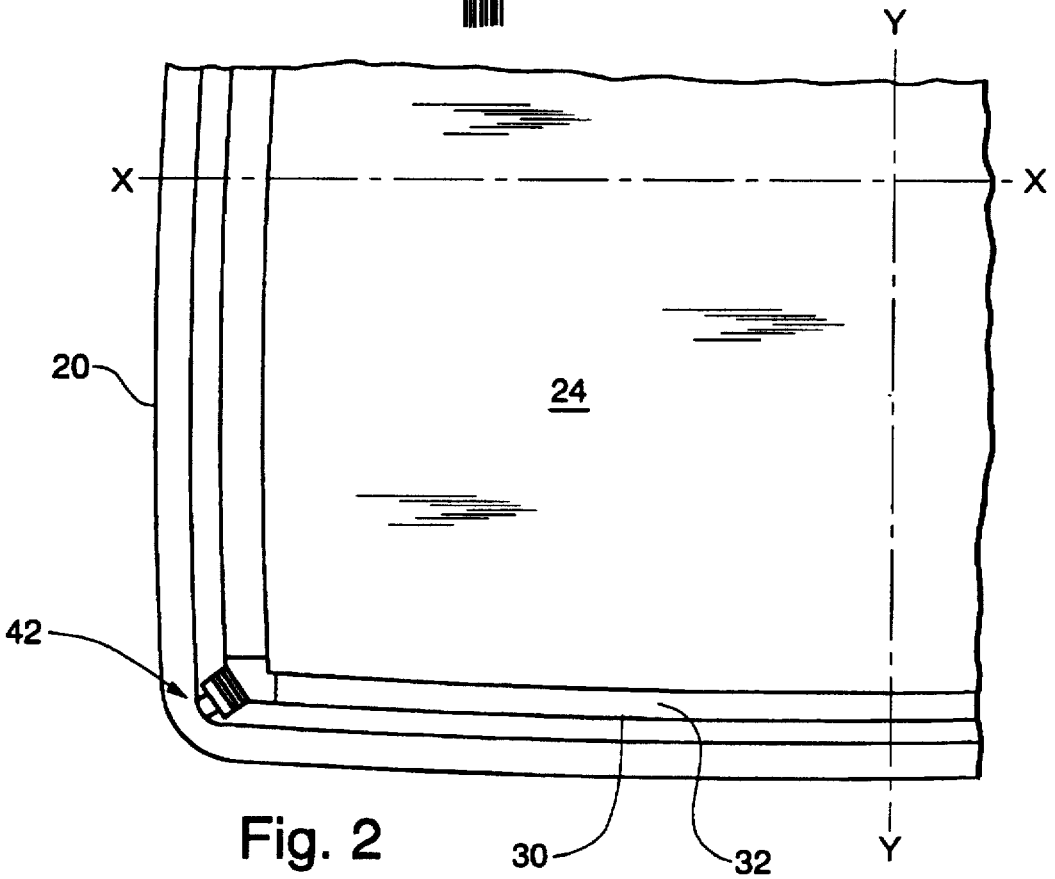
FIG. 2 is a plan view of a quadrant of the tube faceplate, taken at line 2—2 of FIG. 1.

The shadow mask 24 is part of a mask-frame assembly 30 that also includes a novel peripheral frame 32. The mask-frame assembly 30 is shown positioned within the faceplate panel 12 in FIG. 1. The shadow mask 24 includes a curved apertured portion 34, an imperforate border portion 36 surrounding the apertured portion 34, and a skirt portion 38 bent back from the border portion 36 and extending away from the screen 22. The mask 24 is telescoped within or set inside the frame 32, and the skirt portion 38 is welded to the inside surface of a first flange 40 of the frame. As shown in FIG. 2, the mask-frame assembly 30 is mounted within the panel 12 by four support means 42 positioned at the four corners of the assembly.

Figure 3:
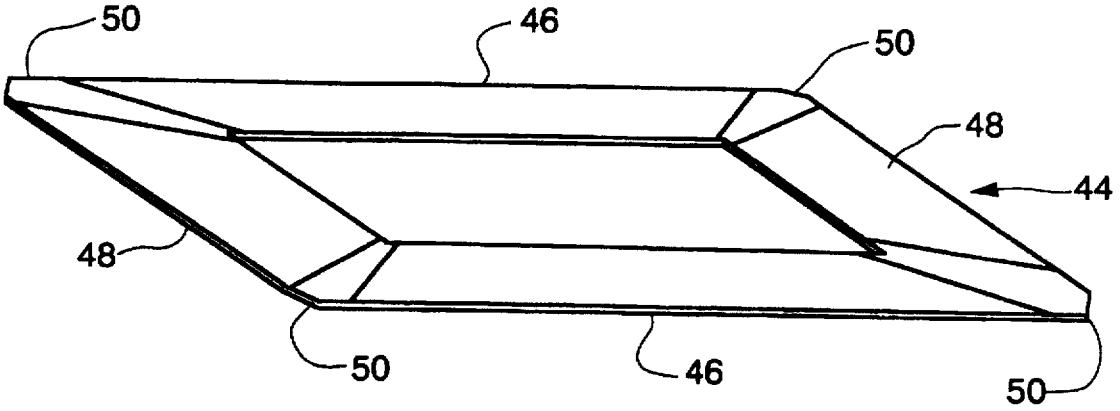
FIG. 3 is a perspective view of an eight section flat frame blank.
Figure 4:
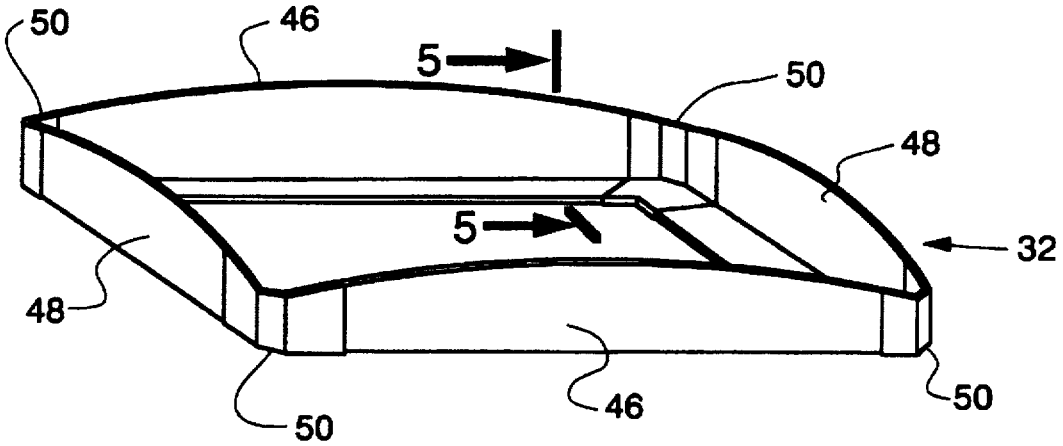
FIG. 4 is a perspective view of a shadow mask frame formed from the flat frame blank of FIG. 3.

As shown in FIGS. 3 and 4, the novel mask frame 32 is formed from a flat blank 44 comprising eight sections: two identical long side sections 46, two identical short side sections 48, and four corner sections 50. The eight sections are first welded together, such as by TIG welding, in a butted or an edge-to-edge manner in a flat condition; and then they are formed into a final frame shape by pressing, utilizing conventional frame forming tools. The four corners of the formed frame 32 are truncated, being angled approximately perpendicularly to the diagonal directions of the frame. In one preferred embodiment, the corner sections are approximately from 1.0 mm to 1.5 mm thick, and the side sections are approximately from 0.5 mm to 0.75 mm thick. Although the corner sections 50 are shown as being identical in shape, they also can be different from each other, such as to extend a greater length along the long sides of the frame.

Figure 5:
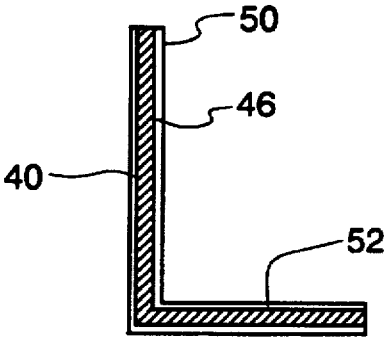
FIG. 5 is an enlarged view of the shadow mask frame, taken at line 5—5 of FIG. 4.

The frame 32, as shown in FIGS. 5, includes two substantially perpendicular flanges, the first flange 40, to which the mask is welded, and a second flange 52. The two flanges 40 and 52 are arranged in an L-shaped cross-sectional configuration. The first flange 40 extends from the intersection of the flanges, in a direction toward the screen 22. The second flange 52 extends inwardly from the intersection of the flanges, in a direction toward the central longitudinal axis Z of the tube 8.

Although the frame 32 is shown as a planar type, the present invention can be applied to any frame geometry, such as a barrel or a bowed shape of frame. A frame constructed in accordance with the present invention uses a minimum amount of material and is lighter than a one-piece frame of similar strength fabricated from uniform thickness material. The overall reduction in material used in the novel frame results in a cost reduction, excellent size control and reduced warpage during long-term operation.

What is claimed is:

1. In a color picture tube including a evacuated envelope having a rectangular faceplate panel, said panel including a viewing screen on an inner surface thereof and a shadow mask frame assembly mounted therein, and said shadow mask frame assembly including an aperture shadow mask and a peripheral frame to which said mask is attached, said peripheral frame having an L-shaped cross-section, the improvement comprising:

said peripheral frame including eight sections; two identical long side sections, two identical short side sections, and four corner sections, that are attached together edge-to-edge, and said two long side sections and said two short side sections being thinner than said four corner sections, said attached eight sections shaped in to said L-shaped cross-section from a flat condition by pressing.

2. The tube as defined in claim 2, wherein the thickness of said two long side sections and said two short side sections is approximately 0.5 mm to 0.75 mm, and the thickness of said corner sections is approximately 1.0 mm to 1.5 mm.

* * * * *